US005642568A

United States Patent [19]

Lapka

[11] Patent Number: 5,642,568

[45] Date of Patent: Jul. 1, 1997

[54] TACK STRIP INSTALLATION TOOL

[76] Inventor: Jay T. Lapka, 310 W. North Ave., Industry, Ill. 61440

[21] Appl. No.: 588,266

[22] Filed: Jan. 18, 1996

[51] Int. Cl.[6] ..... G01B 1/00

[52] U.S. Cl. ..... 33/526; 33/626; 269/53

[58] Field of Search ..... 33/526, 626, 832, 33/833, 645, 646–649, 527; 269/53, 54, 541–545

[56] References Cited

U.S. PATENT DOCUMENTS

| | | | |
|---|---|---|---|
| 370,019 | 9/1887 | Moberg | 33/646 |
| 418,754 | 1/1890 | Schill | 33/646 |
| 489,287 | 1/1893 | Comstock et al. | 269/54.2 |
| 839,142 | 12/1906 | Hebert | 33/646 |
| 1,097,146 | 5/1914 | Snyder | 33/646 |
| 2,319,647 | 5/1943 | Vautrot | 33/832 |
| 2,759,268 | 8/1956 | Cook | 33/526 |
| 3,790,976 | 2/1974 | Stencil . | |
| 4,204,625 | 5/1980 | Glenn . | |

*Primary Examiner*—William A. Cuchlinski, Jr.
*Assistant Examiner*—Andrew Hirshfeld
*Attorney, Agent, or Firm*—Joseph W. Holloway

[57] ABSTRACT

A hand held tool for locating a tack strip proximate a wall includes a metal plate shaped to provide a head having an extending handle for manually gripping the tool. The head has a narrow edge surface which is slotted and sharpened for receiving and holding a tack strip in transverse relation to the head. The head has a spacing gage adjustably mounted thereon which projects frontally for abuttment with the wall. One embodiment of the spacing gage has a projecting end shaped to serve as an awl for locating and starting anchor nails in the tack strip.

12 Claims, 3 Drawing Sheets

TACK STRIP INSTALLATION TOOL

BACKGROUND OF THE INVENTION

This invention pertains to tools for installing tack strips to which the perimeter of a carpet or rug may be anchored and retained in a well understood manner.

Commonly, a tack strip comprises an elongated, somewhat flexible wooden strip displaying a multitude of sharp tack or nail points which penetrate the parallel top and bottom surfaces of the strip and protrude from the top surface at an acute angle thereto for piercing and gripping the backing of a carpet which is pressed into overlying contact with the strip. The forward edge of the strip toward which the points project is sloped at an acute angle relative to said top surface thereby forming a sharp frontal edge or nose which protrudes in the same direction as the points. The rear edge of the strip is normal to the top and bottom strip surfaces.

Since tack strips commonly display rough and splintered surfaces as well as the usual array of tack points, manual handling of these strips presents a formidable and longstanding personal hazard to workmen who routinely install such strips on the job. Conventionally, tack strips are installed on the floor of a room to be carpeted wall-to-wall by the following steps:

1. A number of strips are arranged on the floor about the perimeter of the work area in spaced relation to the line of intersection of the floor and the room walls or baseboards as the case may be. These strips may be laid or dropped by a workmen generally in end-to-end relationship and with the tack points and the tapered strip edge directed toward the wall. At this stage substantial missalignment of the strips relative to one another and relative to the wall surface is common and not unexpected. An inattentive or distracted workmen may inadvertantly position some or all of the several strips backward, i.e. with the tack points projecting not toward the wall but, instead, toward the interior of the room.

2. The installer, while kneeling on the floor, grasps an individual strip with his fingers and positions it with respect to a wall so that the full length of the tapered edge of the strip is spaced a predetermined distance from and generally in parallel with the facing surface of a wall, baseboard or other object. A hand-held gage strip or block is usually inserted between the strips and the room walls to maintain a preselected wall-to-strip spacing. The appropriate width of this space is determined by the thickness of the severed marginal edge of the carpet which is usually pressed downwardly over the nosed edges of the strips into the elongated channel defined by the wall, the floor and the front edge surface of the strip. The required width of the gage strip will vary from job to job. Such gages are commonly misplaced or lost only to be replaced by roughly crafted replacements made on the job.

3. While individual strips are held in spaced relation with an adjacent wall surface, the workman affixes the strips to the floor by hammering several anchor nails through each strip into the floor. Tack strips usually carry prestarted nails which extend vertically at spaced intervals along the elongated top surface of the strip. However, where short strip segments are required, nail starting holes must be made on the job by the tack strip installer.

Since the installation of tack strips must be completed prior to carpet attachment and stretching, speed and accuracy in the performance of this initial task is required so that carpet installation may go forward at a rapid and steady pace. However, in spite of the need for a high level of efficiency on the part of personnel charged with tack strip installation, this important job is often assigned to the most junior members of a carpet contractor's work crew because, as presently performed, this is considered by most workmen to be an irksome and unwanted task.

The major difficulty encountered in installing tack strips is the unavoidable trauma to an installer's fingers and hands from contact with the pointed tips of tacks or nails projecting from the multitude of strips he is required to move into place and then hold in position during the subsequent nailing operation. Not only are the several points on each strip spaced too closely together to afford easily accessed, point-free grasping surfaces; but, the extreme sharpness and acute angulation of the points usually results in skin piercing instantly upon contact and further painful trauma follows when the strip is thereafter squeezed sufficiently to lift or otherwise move the same from place to place. Installer's fingers and hands often become infected, scabbed and extremely sore under such adverse conditions. In an effort to reduce injury and economic loss caused by such repetitive puncturing, cutting and hooking, an installer may wear gloves or may heavily tape those fingers used to grasp the tack strip. However, such finger-worn protective expedients are largely ineffective not only because of rapid deterioration of the tape or the gloves, but mainly because of an unacceptable drop in strip manipulating speed when such measures are taken. Even experienced tack strip installers may become so highly irritated and frustrated by repetitive traumatic contacts with tack points that they cannot perform this task in a consistantly proficient manner. Disconcerted workmen, experienced or not, have been known to nail tack strips in place with the tack points projecting in the wrong direction thereby causing a costly work delay to correct the fault when carpet installation was later begun. Erratic strip-to-wall spacing is a more common, but no less troublesome, problem which usually requires removal and replacement of the misaligned strip or strips whereby carpet installers are held up accordingly and must be temporarily diverted to other tasks.

The foregoing general description of the conventional method of tack strip installation and the recitation of the several longstanding problems encountered suggest that an implement or tool for obviating these problems would contribute significantly to the safety and productivity of professional installers and would correspondingly reduce monetary losses incurred by carpet installation contractors due to on-the-job delays and employee injuries. An installation tool designed to meet these challanging requirements would have at least these desirable characteristics and capabilities:

- Use of the tool will substantially reduce or eliminate hazardous manual handling of tack strips during the positioning and nailing steps.
- The tool structure incorporates adjusting means providing substantial regulation of the spacing between the tack strip and an adjacent wall.
- The tool itself will indicate to the user when a tack strip engaged by such tool is reversed i.e. the tack points are pointed away from an adjacent wall.
- Proficiency in the use of the tool can be quickly developed by inexperienced installers.
- The tool is a compact hand-held type and is, therefore, easy to manipulate.

SUMMARY OF THE INVENTION

A general object of this invention is to provide a tack strip installation tool which displays the desirable structural characteristics and operating capabilities listed above.

A primary object is to provide a simple tool which an installer can employ in place of his fingers for grasping and thereafter manipulating a tack strip. To this end, the tool is gripped by a projecting handle which locates the user's fingers remotely from the point of operative contact between the tool and the tack strip. The underside of the tool head is recessed to form a notch sized to accept and thereafter retain a tack strip in response to a simple tilting or pivoting movement of the tool.

Another primary object is to combine with the aforedescribed tool head an adjustable spacing gage projecting frontally from the head at right angles to a strip captured by the notched head. In operation the strip is first grasped by forcing the tool head downwardly to seat the strip in the notch then the joined tool and strip are moved forwardly along the floor to abutt the extreme front end of the gage against the wall, baseboard or the like. A related object is to provide an enlarged distal end for the spacing gage which is useful for bending crooked strips into proper alignment for nailing.

Yet another important object and advantage is the provision of a simple and reliable means for detecting when a strip which is overlain by the aforedescribed notch in the tool head is incorrectly oriented, i.e. its tack points are directed toward the installer and away from the wall. This feature of the inventive tool is achieved through the novel interaction of the strip-embracing notch in the tool head and the spacing gage. To this end the front of the notch is defined by a sloping blade which is adapted to cut easily into the tapered front edge of a strip as the tool head is pressed into overriding engagement with the top surface of the strip. When the tapered front strip edge faces the keen edge of the blade, the exertion of a modest force will be sufficient to cut far enough into the strip to allow the enlarged distal end of the spacing gage to move downwardly into abutting engagement with the subjacent floor surface. However, if the untapered rear edge of the strip faces the blade, the same or even a substantially greater manual force will not be sufficient to thrust the blade into the strip deeply enough to allow the spacing gage to move downwardly to bump against the floor as expected. A sensed increase in the resistance to the cutting action of the blade together with an absence of the perceptible sound when the gage makes contact with the floor will clearly indicate to the user that the strip is improperly oriented in the toot head notch.

A more detailed object of this invention is to provide a modified spacing gage which performs the several functions described above and additionally provides an enlarged distal end employable, when needed, as an awl for making nail starting holes in short tack strip pieces.

Other specific objects are realized by providing a tack strip installing device displaying the following advantageous features:

- The tool is made of standard materials and by common manufacturing processes and assembly technics.
- While the tool displays compactness and light weight, it is ruggedly constructed to resist damage due to rough handling and careless storage.
- Due to the simplicity of its structure, the tool can be mass produced at low cost and can be purchased at a correspondingly low price.

These and other advantages and objects of this invention and the manner of attaining them will become apparent and the invention will be best appreciated and fully understood by having reference to the following detailed description of embodiments of the invention taken in conjunction with the accompanying drawings.

DETAILED DESCRIPTION OF THE INVENTION

Figure 1:
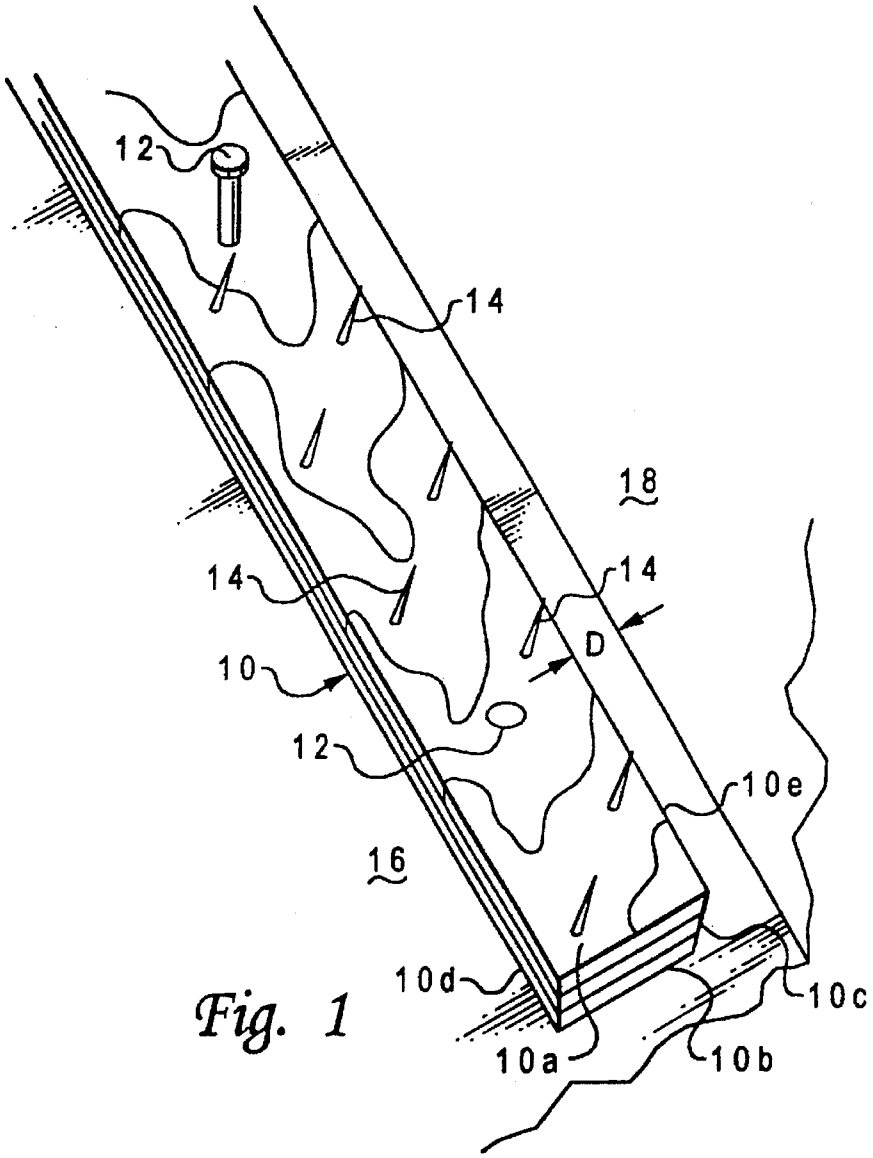
FIG. 1 is a perspective view showing the structural features of a tack strip.

FIG. 1 shows a fragment of a conventionally constructed and dimensioned piece of laminated tack strip 10. The strip is relatively thin and narrow, usually 1 inch wide and ¼ inch thick, and is manufactured in standard lengths of 48 inches. In transverse cross section, the strip is trapezoidal in shape being defined by parallel top and bottom surfaces **10*a* and 10*b* respectively, by a sloping frontal edge 10*c*, and by an upright rear edge 10*d*. The top surface 10*a* and the forwardly facing edge 10*c* intersect to form a sharp frontal nose 10*e* along the entire length of the strip 10. Tacks or small nails 14 penetrate the strip upwardly from the bottom surface 10*b* through and beyond the upper surface 10*a* so that their sharpened, needle-like points project from the top surface approximately ¼ inch. Such tack points emerge at an angle to the top surface which inclines the points toward the frontal edge 10*c* and the nose 10*e* for a purpose to be described. As shown in FIG. 1, the tack points are arranged in two staggered rows along the length of the strip with the interpoint spacing being approximately one inch or less. Each strip carries along its longitudinal centerline a plurality of anchor nails 12 spaced at intervals of approximately 6 inches. Such nails may be prestarted in the manner illustrated by one nail 12 protruding upwardly from the top surface 10*a* in FIG. 1**. Depending on the type of floor subjacent a strip, the started nails may be either standard wood nails or hardened nails adapted to be driven into masonry.

Since the use of tack strips as a means for anchoring the perimeter of a stretched carpet is old and well understood, further explanation of the carpet installation process will be limited herein to that necessary to understand and appreciate the operation and advantages of the tack strip installation tool comprising this invention.

Essentially, for a tool to enhance the safe and efficient installation of tack strips, it must exhibit a good capability for initially gripping the strip 10 and holding the same as the installer slides the entire strip forwardly across the floor toward a facing wall 18 or other vertical surface. Equally important as the gripping function is the tool's strip-locating function whereby the forward movement of the tool is arrested when the space between the frontal nose **10*e* of the strip and the wall 18 reaches a preselected width. In FIG. 1, for example, the width of the desired preset space between the wall 18 and the strip 10 is indicated by the letter D. As noted above, this spacing is chosen to create an elongated channel bounded by floor 16, wall 18 and strip edge 10***c* and into which the marginal edge of a carpet is compressively tucked after the carpet backing is attached to the strip 10 by forcibly pressing the same into gripping contact with the tack points 14.

Figure 2:
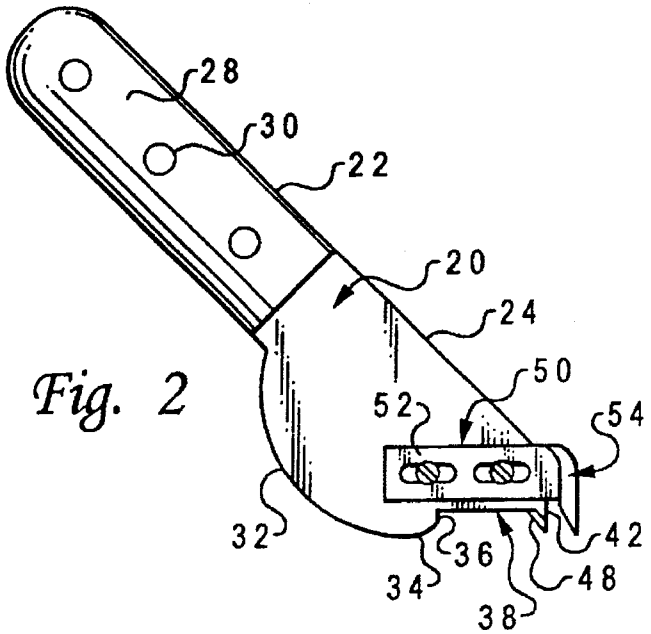
FIG. 2 is a side elevation of an installing tool according to the present invention.
Figure 5:
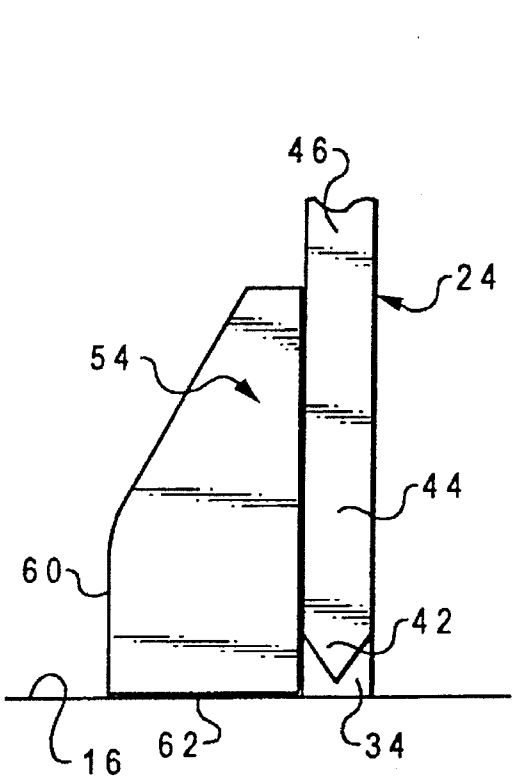
FIG. 5 is a front elevation of the tool shown in FIG. 4.
Figure 4:
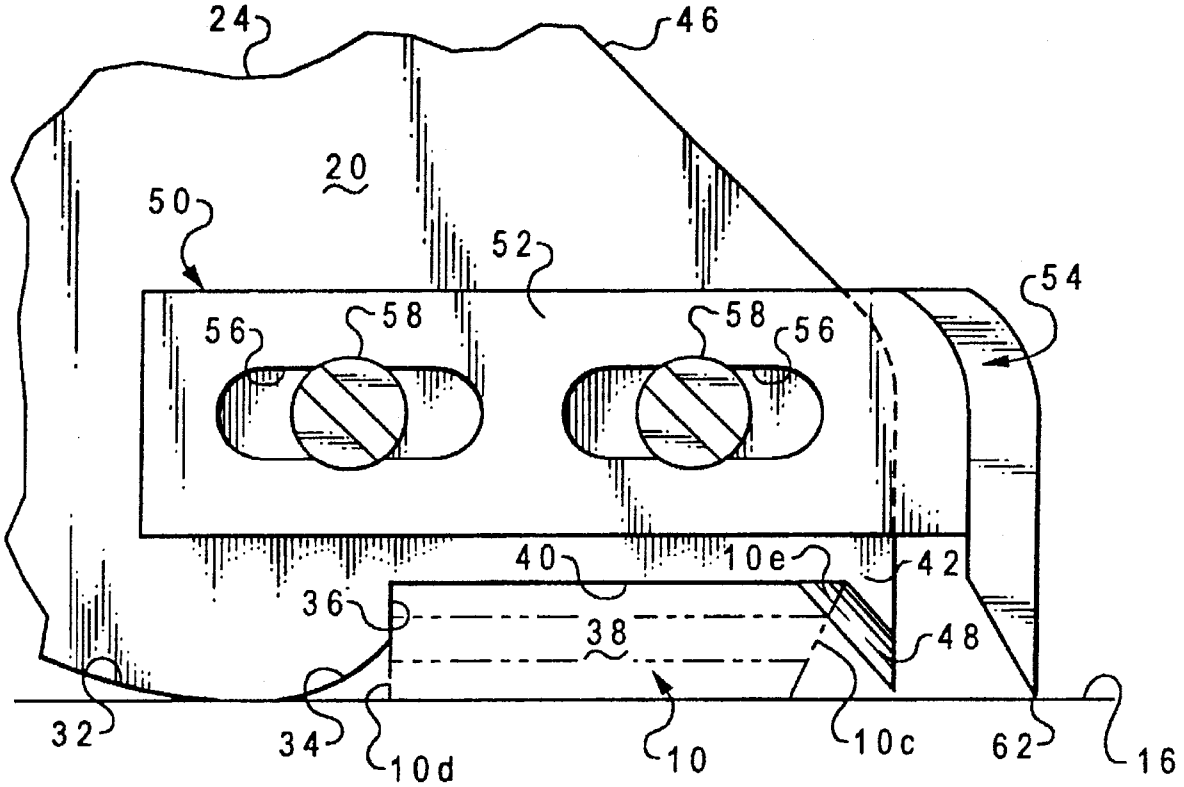
FIG. 4 is an enlarged fragmentary side elevation of the tool shown in FIG. 2 showing the cross section of a tack strip in phantom lines.

In accordance with this invention, the grasping and locating tool functions mentioned above are carried out by a hand tool shown in FIG. 2 and designated in its entirety by numeral 20. This tool is cut or punched from steel plate and has an elongated handle 22 protruding from a somewhat enlarged head 24. To facilitate comfortable and efficient manual gripping of the handle 22, a side plate 28 appropriately shaped and preferably made of non-slip material is attached to the opposed flat sides of the handle by cross rivets 30 or like fasteners. Commencing just forwardly of the handle plates 28, an arcuate edge surface 32 defines rear and bottom portions of the perimeter of the head 24. This surface connects transitionally with another curved edge surface 34 which intersects the upright rear wall 36 of a downwardly opening slot 38 in the bottom of the head 24. As best shown in FIG. 4, the flat surface 40 which in part defines the slot 38 connects perpendicularly with the rear wall 36 and extends forwardly toward a beak-like protuberance 42 depending at the lower frontal terminis of the tool 20. The front surface of beak 42 is shown in FIG. 5 and comprises a flat edge 44 of the tool head 24 which extends vertically downwardly from the tool's upwardly inclined leading edge 46. The protruding beak 42 is sharpened by grinding to create a keen blade 48 which forms the front wall of slot 38 and faces rearwardly toward the slot. The edge of the blade 48 slopes downwardly and forwardly at an obtuse angle with respect to the upper slot surface 40 whereby the width of the slot 38 increases progressively as the slot opens toward the floor surface 16.

An essential component of the tool 20 is a strip-spacing gage, generally indicated in FIGS. 2 through 5 of the drawings by numeral 50. The gage comprises a flat, rectangular tang 52 having an integral head 54 which projects laterally from the front end of the tang at a right angle thereto. A spaced pair of elongated apertures 56 which extend transversly through the tang freely receive a pair of threaded fasteners having slotted heads 58. Each of these fasteners is threadably received in an aligned bore in the tool head 24; and, when firmly tightened against the tang 52, the fasteners fix the gage and the tool head in laterally juxtaposed relation as depicted in FIG. 5. The lower portion of the gage head 54 depends downwardly from the forward end of the tang 52, as best shown in FIG. 4, toward the floor surface 16. In frontal profile, as viewed in FIG. 5, the head 54 flares laterally from the tang 52 to a vertical edge 60 which intersects a bottom marginal edge 62. The thickness of the bottom portion of head 54 decreases in a tapering manner to that of the blunt edge 62. The projection of gage 50 beyond the front edge 44 of the tool head 24 is adjustable between limits by loosening the fasteners 58 and sliding the tang 52 rectilinearly with respect to head 24.

A modification of the above described spacing gage 50 is illustrated in FIGS. 6 through 9 where numeral 64 indicates the modified gage in its entirety. The tang 66 of gage 64 is substantially the same as tang 52 of gage 50 whereby the gages 50 and 64 may be interchangeably mounted on a common tool 20 by means of the same fasteners 58.

Figure 7:
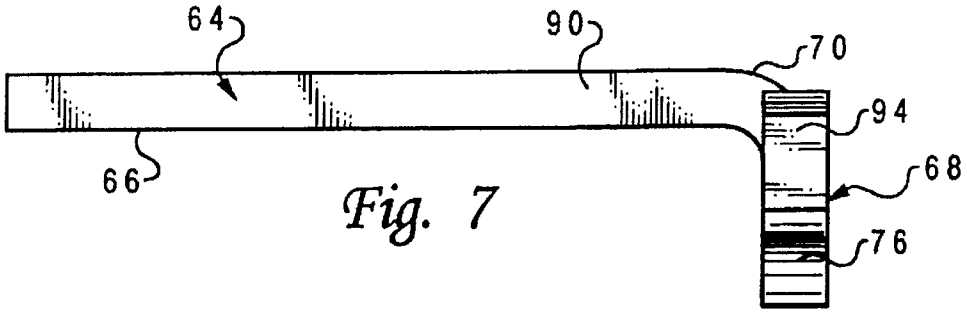
FIG. 7 is a top plan view of the modified spacing gage.

The major structural changes incorporated in gage 64 involve the gage head 68 which is advantageously modified for creating starting holes for anchoring nails in short tack strip segments. FIG. 7 shows that the head 68 is integrally connected at a right angle to the rearwardly extending tang 66 by a curved transitional wall 70 which, in a skirt-like manner, extends below the lower tang surface 72 and terminates at the bottom edge 74 of the head 68 shown in abutting engagement with the floor surface 16. When the tool head 24 is held vertically, as in FIG. 8, the wall 70 is perpendicular to the floor surface 16; however, the head's opposed side wall 76 will then be slanted upwardly toward the tang 66. This sloped side wall 76 in part defines an elongated portion 80 of the gage head 68 which, in a manner to be described, serves as an awl. The pointed tip 82 of this elongated portion 80 is defined by the intersection of appropriately shaped head surfaces 84, 86 and 88; and, the tip 82 is aligned with the head's bottom edge 74. The awl portion 80 extends upwardly beyond the upper tang surface 90 in the form of a rectilinear anvil 92 having a flat upper impact surface 94.

OPERATION OF THE INVENTION

Figure 3:
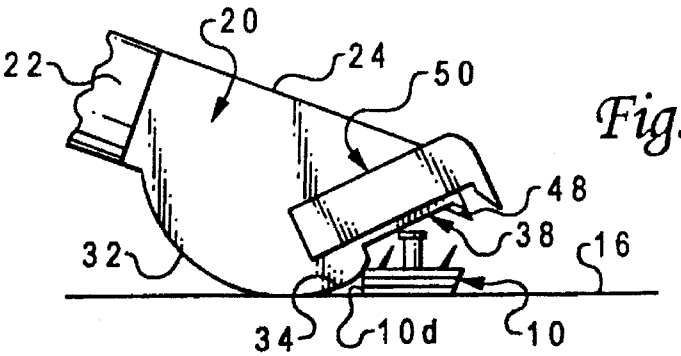
FIG. 3 is a fragmentary side elevation showing the outline only of the tool in a moved position.

An installer grips the handle 22 of the tool 20 to point the head 24 and the entrance to the slot 38 toward a tack strip section 10 disposed upon the floor surface 16. The arcuate rear edge 32 of the tool is brought into contact with the floor somewhat to the rear of a tack strip with the tool head 24 pivoted upwardly as shown in FIG. 3. The installer then skids the tool upon edge 32 forwardly along the floor with the slot 38 overriding the strip 10 until contact is made with the rear strip edge 10*d*, generally as shown in FIG. 3, whereupon the handle 22 is raised to pivot the head 24 downwardly about its point of contact with the floor surface. Such pivotal movement causes the curved edge 34 of the head to cam the strip forwardly until the rear strip edge 10*d* registers vertically with the rear wall 36 of the slot 38. Further pivoting of head 24 places the blade 48 in contact with the pointed strip nose 10*e*, whereafter the rearward slope of the blade 48 acts to wedge the strip edge 10*d* rearwardly against the rear wall 36 of the slot 38. A final increment of applied pivotal movement causes the blade 48 to enter easily into the angulated nose 10*e* to the full extent shown in FIG. 4, whereby the strip 10 is compressively captured in the slot 38 between the wall 36 and the V-shaped blade surface and the strip's top surface 10*a* is in full contact with the overriding slot surface 40. The aforedescribed pivotal tool movement is arrested by the engagement of the slot surface 40 against the strip surface 10*a* and simultaneously by the abuttment of the bottom edge 62 or 74 of the head of a spacing gage 50 or 64 against the lower surface 16, as the case may be.

With the strip 10 gripped in the tool slot 38, as shown in FIG. 4, the tool is advanced toward wall 18 to abut the extreme frontal surface of gage head 54 against the wall 18 whereby the front edge 10*e* of the strip 10 will be spaced at the preset distance D from the wall illustrated in FIG. 1. It will be understood that any preset strip-to-wall spacing initially established can be later changed as desired by loosening the fasteners 58 to regulate the distance between the front face of head 54 and the nose 10*e* of a strip fully seated in the slot 38. If a tack strip section 10 is not crooked, i.e. the front edge 10*e* generally parallels the wall surface 18, a full 48 inch long strip may be grasped by the tool 20 near its midpoint and secured from end to end by setting the anchor nails 12 in any order. If, however, the strip is quite crooked, the strip is grasped proximate one end which is held in correctly spaced relation to the wall and nailed. The strip is then released from the tool; and, the tool is reset along the strip where required to adjust the strip-to-wall spacing prior to setting the remaining nails. If a portion of the front strip edge 10*c* is bent toward the wall 18 closer than the desired distance D, the tapered bottom edge of either of the spacing gage heads 54 or 68 may be tilted and inserted between the strip and the wall and thereafter manipulated by twisting or otherwise to bend the strip outwardly from the wall so that the tool head 24 can be pressed downwardly to grip the strip in the aforedescribed manner.

Figure 8:
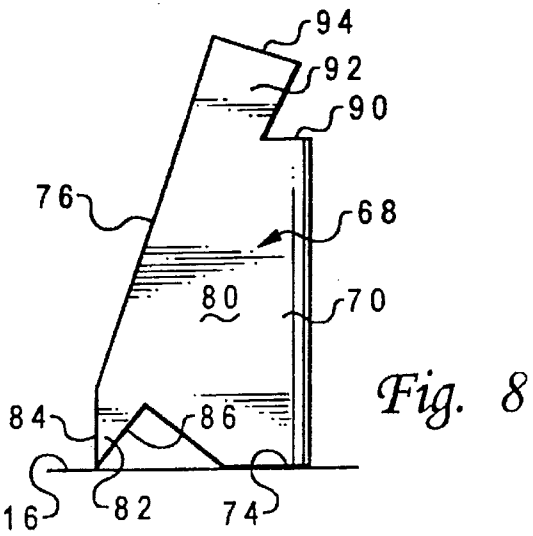
FIG. 8 is a frontal elevation of the modified gage.
Figure 9:
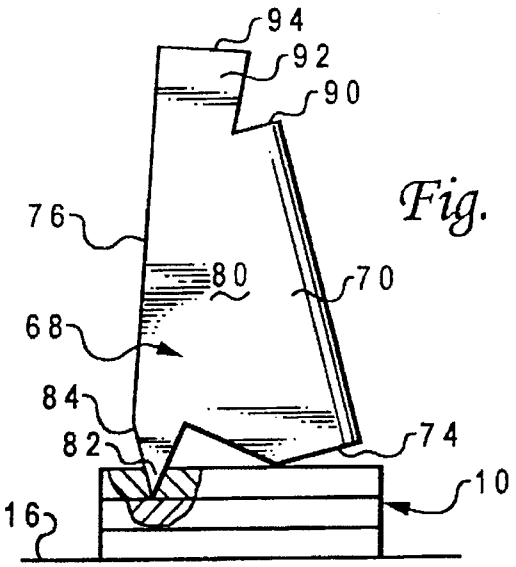
FIG. 9 is a frontal elevation of the modified gage depicting the same in a tilted operating condition.
Figure 6:
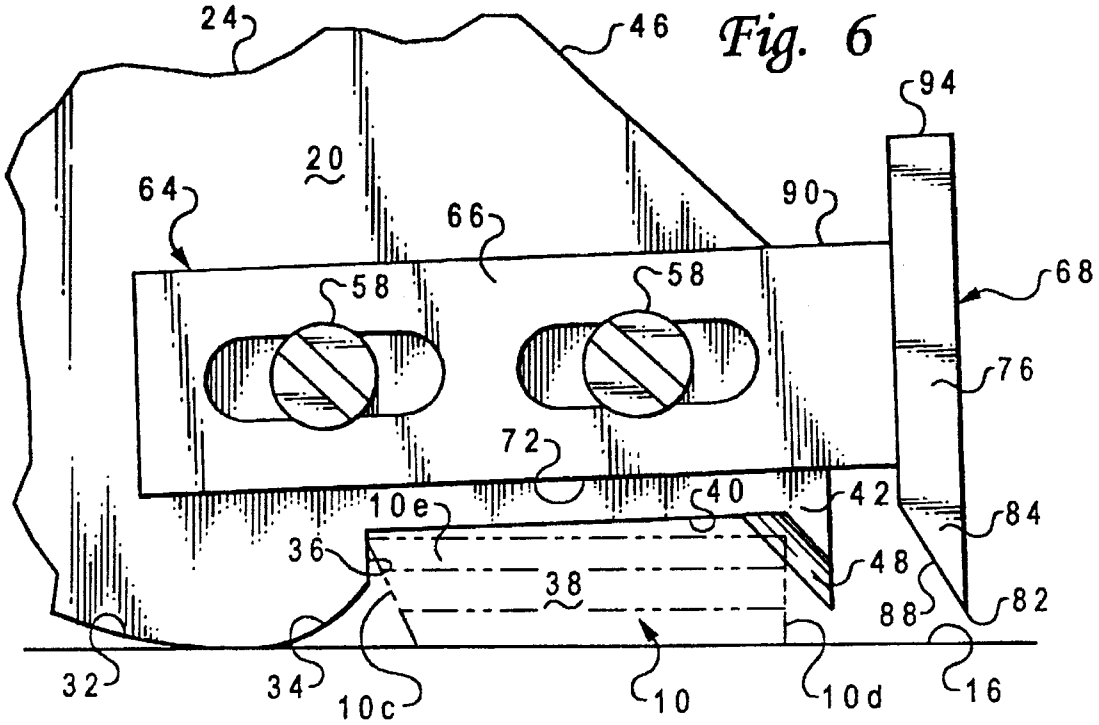
FIG. 6 is a view similar to FIG. 4 depicting a modified spacing gage element of the tool and showing a cross section of a tack strip in phantom lines.

Occasionaly, a short piece of tack strip which carries only one or possibly no preset anchor nail 12 must be nailed down as the final piece along a wall or around a door jam, for example. If the installer holds a relatively short anchor nail between his fingers and against a strip to prestart the nail, he risks injuring his fingers on the sharp tack points 14. This arduous job is greatly simplified and made safer through the use of the awl-like head 68 of the modified spacing gage 64 shown in FIGS. 8 and 9. When resting on the floor 16, as shown in FIG. 8 the bottom edge 74 of the head 68 serves the same functions as the bottom edge 62 of the head 54 previously described in detail. To operate the head 68 as a hole-making awl, the entire tool is cocked slightly by the installer in the manner shown in FIG. 9 whereby an imaginary line connecting the awl point 82 and the center of the anvil's impact surface 94 is made perpendicular to the strip 10 at the desired hole location. Thereafter, it remains only for the installer to bump the impact surface 94 with his hand or to tap the same with a hammer depending on the puncture resistance of the strip 10 and the size and depth of the hole desired.

An unexpected operational benefit afforded by tool 20 results from the utilization of a blade 48 to define the front side of the slot 38. As earlier stated, the blade can be easily pressed into the strip nose 10*e* to the extent normally expected and depicted in FIG. 4 with only minimal operator effort. Contrarily, the blade's penetration of the strip will be limited to that depicted in FIG. 6 in the event the strip is unintentionally reversed from the correct position shown in FIG. 4. This is due to the increased resistance to cutting offered by the squared corner defined by the top and rear strip walls, 10*a* and 10*d* respectively. FIG. 4 also indicates that such limited penetration of the blade 48 into the strip arrests the pivotal movement of the head 24 about its point of contact with the floor 16 and, likewise, prevents contact between the floor and a spacer gage 50 or 64 attached to the tool head 24. In this event, the installer is prewarned before nailing that the strip 10 has been incorrectly grasped by the tool 20.

The foregoing description of the embodiments shown in the drawings is illustrative and explanatory only; and, various changes in size, shape and material as well as the specific details of the illustrated construction may be made. Therefore, I do not intend to be limited to the details shown and described herein, but intend to cover all changes and modifications which are encompassed in the scope and spirit of the appended claims.

What I claim as my invention is:

1. A device for grasping and positioning a tack strip comprising:

a flat head having a curved perimetric edge surface;

a tack-strip grasping notch formed in said head and opening to said edge surface;

said notch being bounded by first and second walls and a third wall the latter comprising the edge of an elongated blade;

said first and second walls intersecting substantially perpendicularly; and, said blade confronting said first wall and intersecting said second wall at an obtuse angle.

2. The device set forth in claim 1, wherein said edge surface defines a curved cam surface adjacent said notch.

3. The device set forth in claim 2, wherein said cam surface defines a pivot for said head; and, wherein movement of said head about said pivot can press said blade into a tack strip grasped in said notch.

4. The device set forth in claim 1, further including gage means projecting from said head and having a distal end for abutting an upright surface.

5. The device set forth in claim 4, wherein said gage means is adjustably mounted on said head.

6. A combination of a tack strip with a hand-held tool for locating the tack strip proximate an upright surface, comprising:

a) projecting handle means;

b) head means attached to said handle means;

c) said head means having a peripheral edge surface;

d) said edge surface having an elongated slot having therein the tack strip extending transversly of said head means;

e) spacing gage means carried on said head means and projecting outwardly therefrom at right angles to the tack strip received in said slot; and, f) said gage means having a distal end abuttable with said upright surface to locate said slot and the tack strip received therein relative to said upright surface.

7. The combination defined in claim 6, wherein a portion of said edge surface defining said slot is sharpened and projects toward said slot in incising engagement with the tack strip received in said slot as aforesaid.

8. The combination defined in claim 7, wherein said sharpened edge surface portion is formed on a protuberant portion of said head means which extends oppositely from said handle means.

9. The combination defined in claim 6, wherein said gage means has an elongated shank attached to and movable with respect to said head means for selectively varying the projection of said gage means relative to said head means.

10. The combination defined in claim 9, wherein said distal end of said gage means depends from said shank and has a straight bottom edge.

11. The combination defined in claim 10, wherein said distal end defines a point which is laterally separated from said straight bottom edge.

12. The combination defined in claim 11, wherein said distal end defines an anvil extending therefrom in aligned opposition with respect to said point.

* * * * *